United States Patent [19]

Gradwohl

[11] Patent Number: 4,970,847

[45] Date of Patent: Nov. 20, 1990

[54] APPARATUS FOR ADVANCING SINGLE SACKS FROM A MAGAZINE TO A FILLING STATION

[75] Inventor: Adolf Gradwohl, Gleisdorf, Austria

[73] Assignee: Binder & Co. AG, Gleisdorf, Austria

[21] Appl. No.: 436,434

[22] Filed: Nov. 14, 1989

[30] Foreign Application Priority Data

Dec. 2, 1988 [AT] Austria ..... 2963/88

[51] Int. Cl.[5] ..... B65B 43/30

[52] U.S. Cl. ..... 53/573; 53/386

[58] Field of Search ..... 53/571, 573, 386, 384, 53/459, 570

[56] References Cited

U.S. PATENT DOCUMENTS

| | | | |
|---|---|---|---|
| 3,566,578 | 3/1971 | Thorne et al. | 53/573 X |
| 3,619,981 | 11/1971 | Burke et al. | 53/573 |
| 3,945,173 | 3/1976 | Buzzi | 53/386 X |
| 4,078,358 | 3/1978 | Henderson | 53/573 X |
| 4,345,629 | 8/1982 | Inglett, Jr. | 53/573 X |

FOREIGN PATENT DOCUMENTS 2452049 11/1974 Fed. Rep. of Germany .

*Primary Examiner*—James F. Coan
*Attorney, Agent, or Firm*—Kurt Kelman

[57] ABSTRACT

The invention relates to an apparatus for advancing an empty sack in a conveying direction to a filling station comprising a charging funnel, which comprises a magazine containing a stack of horizontally extending flattened empty sacks, from which uppermost sacks are successively removed and each uppermost sack is horizontally conveyed in succession. A conveyor is arranged to receive each horizontally conveyed sack in succession, and this conveyor comprises a horizontal support for at least partially supporting each horizontally conveyed sack in succession, a pair of suction devices adjacent a leading edge of the support and arranged at opposite sides of the sack supported thereon, the suction devices being displaceable in a direction extending transversely to the support for gripping and opening the sack on the support, and the support and suction devices being pivotal in unison between a receiving position wherein the support is positioned to receive the horizontally conveyed sack and a transfer position. A pulling-up device is arranged to recieve and grip the sack in the transfer position, and to pull the sack up to the charging funnel at the filling station.

5 Claims, 2 Drawing Sheets

APPARATUS FOR ADVANCING SINGLE SACKS FROM A MAGAZINE TO A FILLING STATION

BACKGROUND OF THE INVENTION (1) Field of the Invention

The invention refers to an apparatus for advancing single sacks from a support to a filling station comprising a charging funnel, said appartus comprising a conveying means having suction devices for the opening and gripping of the sacks, and a pulling up device for pulling up the sack to said charging funnel arranged behind said conveying means.

(2) Description of the Prior Art

In presently known apparatuses the sacks are mostly deposited individually on a rigid support and subsequently conveyed from said location by means of a conveying means with suction devices in the direction of a charging funnel or a pulling up device. As a result of this, sacks slide from the support and sag in a downward direction. This leads to the sack reaching the pulling up device at an unfavourable angle, said pulling up device being arranged rotatably around a horizontal axis. In the case of sacks with gussets it frequently happens as a consequence of the folded gussets that only the lower wall of the sack sags, whereas the upper wall, due to the folded gussets, tends to arch, and, as a consequence of this, said upper wall bridges the increasing distance between the front edge of the support and the suction devices of the conveying means. This leads to a very uneven opening of the gussets and furthermore to problems with gripping of the sacks by means of the pulling up device which should grip the sacks symmetrically.

Such symmetrical gripping, however, by means of the pulling up device, said pulling up device being mostly arranged by straddling spoons engaging into the sack opening and pressing the gussets in an outward direction, is the prerequisite for pulling up the sack concentrically about the charging funnel. This is essential for a wrinkle-free closing of the filled sack by means of a machine.

SUMMARY OF THE INVENTION

It is the object of the invention to avoid deficiencies in the known apparatus of the above kind and to ensure, a symmetrical opening of the sack, in particular when advancing the sack to the pulling up device.

This is achieved in accordance with the invention by coupling the conveying means provided with said suction devices and the support to each other in such a manner that each of their movements are coordinated so that each sack is at least partially supported during its transport to the pulling up device.

These measures ensure that the sack is supported up to its transfer to the pulling up device and, accordingly, prevent an uneven sagging of the sack's walls. This ensures a symmetrical gripping of the sack by the pulling up device and prevents the above mentioned problems.

An apparatus in accordance with the invention may have a pulling up device for gripping the sacks with straddling holding devices and being rotatable around a horizontal axis, and the conveying means provided with suction devices and the support may be pivotal around an axis, preferably around a common axis.

In this way a simple arrangement is achieved.

According to a further feature, the support, in the transfer position and viewed in the conveying direction of the sacks, is positioned obliquely in a downward direction from the trailing edge toward the leading edge of the support and extends substantially tangentially to the position of the pulling up device.

These measures ensure an especially smooth transfer of the sacks from the conveying means to the pulling up device, whereby a deflection of the sack in the area where said sack is transferred to the pulling up device is prevented.

BRIEF DESCRIPTION OF THE DRAWING

The invention is now described in detail by means of the drawing as follows.

DETAILED DESCRIPTION OF PREFERRED EMBODIMENT

Figure 2:
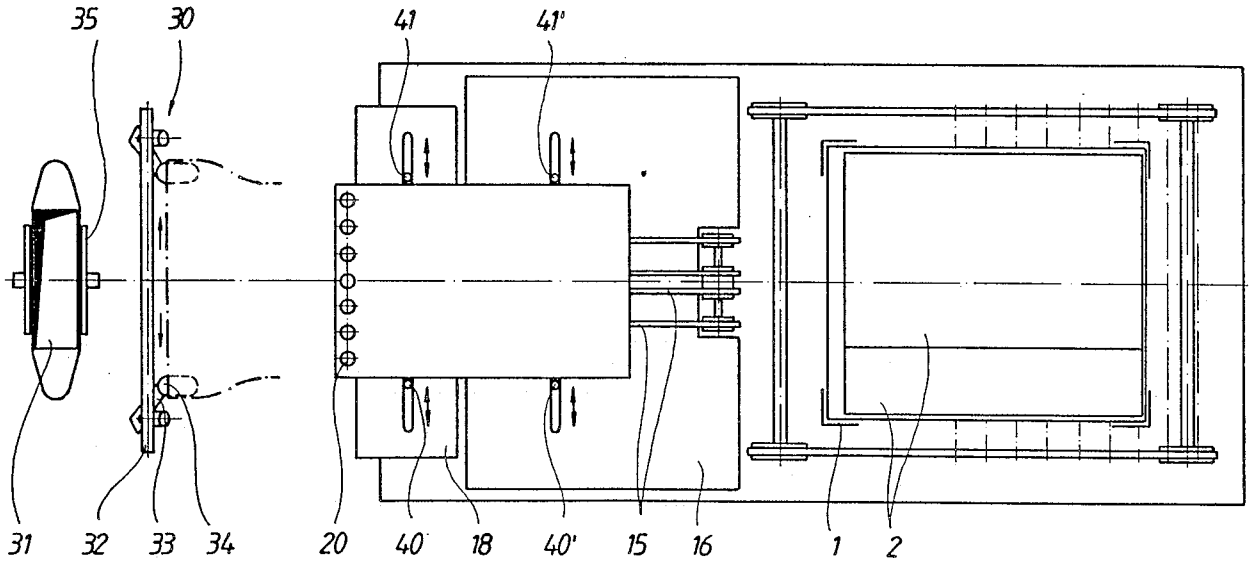

Sacks 2 are stacked in magazine 1, individual sacks 2 or smaller packets thereof being arranged laterally offset from each other, as can be seen in FIG. 2.

The stack of sacks 2 is kept in position by means of the liftable and lowerable floor 5, whereby the top sack 2 is in a position near the upper end of magazine 1.

A chain grate 6 runs around the magazine via pulleys 11, of which one or a pair is driven. Chain grate 6 serves for conveying sacks 2 in the direction of transfer area 7 and said chain grate 6 comprises grate fields 8 in which both chains are connected with grate rods 10 and separated by sections 9 which do not comprise any grate rods 10. Sections 9 are preferably longer than the magazine in the conveying direction of chain grate 6.

A sack removal device 12 is arranged above the magazine, said device being formed mainly by a lever having a suction head 13 at its free end, said lever being movable by means of a cylinder-piston device. The control of device 12 takes place in such a manner that the lever with its suction head 13 dips through the chain grate 6 while a section 9 without grate rods moves along below device 12.

By means of suction head 13 the uppermost sack of magazine 1 may be lifted and one of the ends of said sack is brought into a position above chain grate 6.

Figure 1:
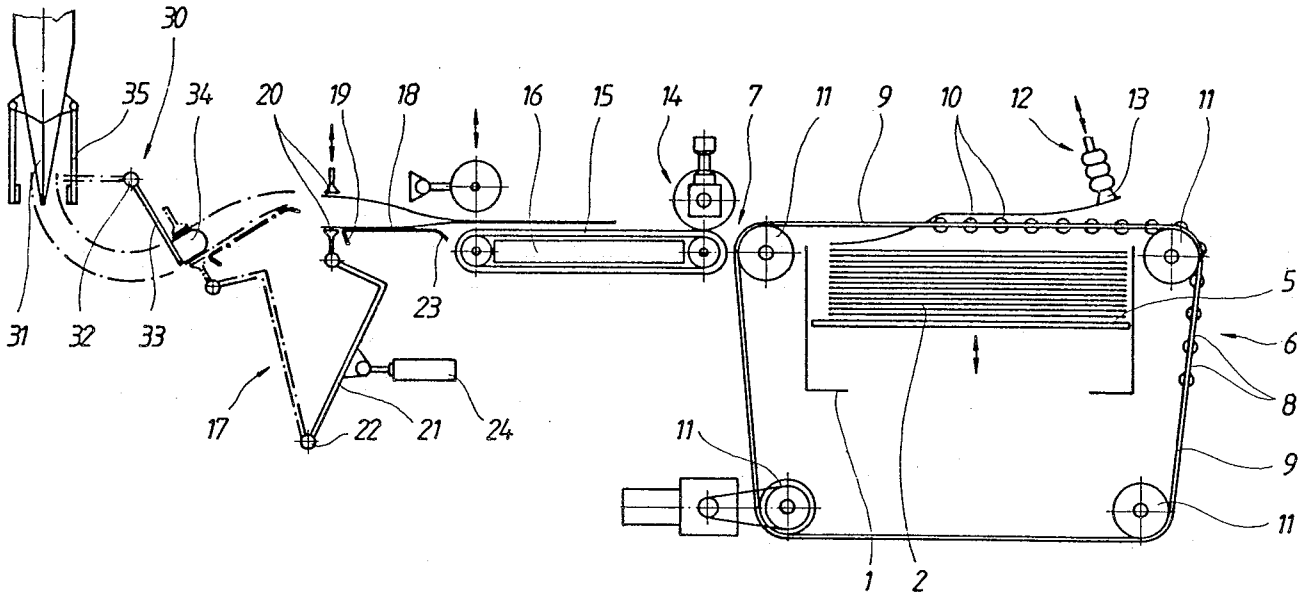
FIG. 1 shows a cross-section of the apparatus according to the invention and FIG. 2 shows a top view of the apparatus according to the invention.

The following grate field 8 lifts, as can be seen in FIG. 1, sack 2, which has already been lifted at its one end, throughout its complete length, whereafter suction head 13 is relieved, so that the end of sack 2 falls on to the chain grate and is conveyed by it.

Chain grate 6 moves sack 2 to a further conveying means 14, said means being formed by several revolving driving belts 15, one strand of which moves slightly above table 16. Belts 15 are driven intermittely and a sensng device, (not shown) controls the drive of the belts so that each sack 2 stops at a position outlined in FIG. 1 in full lines.

After individual sack 2 has been stopped by interrupting the drive of belts 15, a device for aligning the sack transversely to table 16 is activated. As shown in FIG. 3, this device is formed by stops 40, 40', 41, 41', both pairs of stops are moveable against each other. Said stop are fingers penetrating apertures of table 16 and driven under the control of a sensor acting on sack 2.

In this position, sack 2 is gripped by a further conveying means 17, while sack 2 partially rests on table 16 or the stopped belts 15, and partially on support adjoining table 16, a leading end of the sack slightly projecting from leading edge 19 of the support, which is remote from table 16 in the sack's conveying direction.

Conveying means 17 grips the projecting end of the sack by means of suction devices 20 which grips sack 2 and at the same time open said sack by increasing the distance between suction devices 20.

Said suction devices 20 are held in a frame not shown here, said frame being held pivotal around axis 22 by means of a pair of bell cranks, said axis running parallel to the plane of support 18. Axis 22 is arranged lower in a vertical direction than support 18 and in a horizontal direction said axis is arranged nearer to pulling up device 30 than edge 23 of support 18, said edge trailing in the conveying direction of the sacks, with regard to the final position of the sacks being nearest to table 16. At the same time axis 22 is farther away in the horizontal direction from pulling up device 30 than leading edge 19 fo support 18, with regard to the final position of the sacks being closest to pulling up device 30.

The pivoting drive of conveying means 17 and support 18 comprises a cylinder-piston arrangement 24 by means of which the conveying means and support can be pivoted between table 16 and pulling up device (see full and chain-dotted lines in FIG. 1). Sack 2 remains open during this pivoting motion.

Pulling up device 30 mainly consists of two straddling arms 33 pivotal around axis 32 extending parallel to the axial plane of charging funnel 31 and parallel to pivoting axis 22 (see full and chain-dotted lines in FIG. 1). Arms 33 are moveable against each other parallel to axis 32 and comprise at their free ends spoons 34 formed to press the gussets of sack 2 in an outward direction.

As soon as spoons 34 of pulling up device 30 engage in the opening of sack 2 or sack 2 is pulled over said spoons by means of conveying means 17, said spoons straddle in an outward direction, so that the sack is held by spoons 34. Thereafter suction heads 20 of conveying means 17 may be relaxed, so that sack 2 is released, whereafter conveying means 17 is pivoted to its starting position closest to table 16.

Pulling up 30 device now is pivoted in the direction of the closing loading funnel 31 and pushes sack 2 over closing loading funnel 31, whereafter clamping devices 35 are pressed against the walls of sack 2 until the sack walls contact the outer walls of charging funnel 31. Thereafter pulling up device is pivoted further upwards which causes spoons 34 to be pulled out of sack 2.

After filling and depositing filled sack 2, pulling up device 30 is pivoted back to the transfer position outlined in full lines in which spoons 34 are engaged in the next sack, the distance between spoons 34 being reduced during their return stroke.

The position of pivoting axes 22 and 32, as well as the length of arms 21 and 33 are chosen in such a manner that support 18, which is a part of conveying means 17, moves tangentially to the arc of a circle made by spoons 34 in the transfer position of conveying means 17 and pulling up device 30.

Support 18 does not need to support sack 2 over its complete length or height. It is sufficient, as is shown in FIG. 1, if the support is approximately half as long as sack 2. Any folding of the sack over trailing edge 23 of support 18 does not cause any disturbance, as sack 2 is supported in the area of the opening of the sack and therefore the gussets are opened symmetrically. This enables unobstructed taking over of sack 2 by the pulling up device 30, which subsequently enables sack 2 to be pulled up smoothly to the charging funnel 31. The latter is necessary for properly filling the sack in order to close said sack free of folds.

What is claimed is:

1. An apparatus for advancing an empty sack in a conveying direction to a filling station comprising a charging funnel, which comprises (a) a magazine containing a stack of substantially horizontally extending flattened empty sacks, including an uppermost sack, (b) means for successively removing each uppermost sack from the stack and for substantially horizontally conveying each removed sack in succession in the conveying direction, (c) a further conveying means arranged to receive each horizontally conveyed sack in succession, the further conveying means comprising (1) a substantially horizontal support for at least partially supporting each horizontally conveyed sack in succession, (2) a pair of suction devices adjacent a leading edge of the support and arranged at opposite sides of the sack supported thereon, the suction devices being displaceable in a direction extending transversely to the support for gripping and opening the sack on the support, and (3) means for pivoting the support and suction devices in unison between a receiving position wherein the support is positioned to receive the horizontally conveyed sack and a transfer position, and (d) a pulling-up device arranged to receive and grip the sack in the transfer position, and to pull the sack up to the charging funnel at the filling station.

2. The apparatus of claim 1, wherein the pivoting means comprises a common horizontal axis for pivoting the support and suction devices in unison, and further comprising pivoting means for pivoting the pulling-up device about a horizontal axis between the transfer position and the filling station.

3. The apparatus of claim 1, wherein the pivoting means is arranged to position the support in the transfer position to extend obliquely downwardly from a trailing to the leading edge of the support and substantially tangetially to the pulling-up device.

4. The apparatus of claim 1, wherein the pivoting means comprises a common horizontal axis for pivoting the support and the suction devices in unison, the horizontal axis extending below the support and being farther removed in a horizontal direction from the pulling-up device than the leading edge of the support in the transfer position.

5. The apparatus of claim 1, wherein the pulling-up device comprises holding devices straddling the sack.

* * * * *